US006435355B1

(12) United States Patent
Brown

(10) Patent No.: US 6,435,355 B1
(45) Date of Patent: Aug. 20, 2002

(54) MODULAR STORAGE SYSTEM FOR CYLINDRICAL OBJECTS

(76) Inventor: Robert W. Brown, c/o Production Design Products, Inc. 14161 NW. Basalt St., Ramsey, MN (US) 55303

( * ) Notice: Subject to any disclaimer, the term of this patent is extended or adjusted under 35 U.S.C. 154(b) by 0 days.

(21) Appl. No.: 09/158,235

(22) Filed: Sep. 22, 1998

(51) Int. Cl.[7] ..... A47F 7/18

(52) U.S. Cl. ..... 211/44; 211/45; 211/74; 312/184

(58) Field of Search ..... 211/74, 189, 44, 211/85.18, 162, 45, 41.12, 94.01, 94.02, 182, 89.01; 280/79.3; 312/198, 184, 286, 287, 351, 34.8, 34.23, 334.23

(56) References Cited

U.S. PATENT DOCUMENTS

| | | | | | |
|---|---|---|---|---|---|
| 583,727 | A | * | 6/1897 | Braun | 211/74 |
| 2,664,307 | A | | 12/1953 | Wieland | 211/46 X |
| 2,851,167 | A | * | 9/1958 | Rosenberg | 211/46 |
| 3,804,482 | A | * | 4/1974 | Smith | 312/236 |
| 3,806,969 | A | * | 4/1974 | Varama | 6/10 |
| 4,223,792 | A | | 9/1980 | Aspen | 211/162 |
| 4,349,303 | A | * | 9/1982 | Liebel et al. | 410/154 |
| 4,422,555 | A | | 12/1983 | Jacobs | 211/74 |
| 4,476,988 | A | * | 10/1984 | Tanner | 220/1.5 |
| 4,573,644 | A | | 3/1986 | Brown | 242/67.1 |
| 4,660,727 | A | | 4/1987 | Levine | 211/74 |
| 4,666,047 | A | * | 5/1987 | Fletcher | 211/46 |
| 4,824,711 | A | * | 4/1989 | Cagliostro et al. | 428/116 |
| 4,973,010 | A | | 11/1990 | Brown | 242/67.2 |
| 5,171,114 | A | * | 12/1992 | Dunn | 410/154 |
| 5,296,280 | A | * | 3/1994 | Lin et al. | 428/118 |
| 5,384,813 | A | | 1/1995 | Loftis | 376/272 |
| 5,702,151 | A | * | 12/1997 | Grote et al. | 296/187 |
| 5,714,034 | A | * | 2/1998 | Goodhue | 156/512 |
| 5,738,227 | A | | 4/1998 | Duff | 211/60.1 |
| 5,924,577 | A | * | 7/1999 | Gessert | 211/41.1 |

* cited by examiner

*Primary Examiner*—Jerry Redman
*Assistant Examiner*—Khoa Tran

(57) ABSTRACT

A modular storage system for cylindrical objects, such as rolled carpet mats, having an open frame in the form of a right parallelepiped comprised of a horizontal rectangular base, a horizontal rectangular top, and vertical standards connecting the corners of the base and top. Within the frame there are disposed a plurality of pairs of left and right face-to-face vertically extending abutting mirror image formed or shaped shells. Each mirror image shell is formed to define a plurality of alternating inwardly facing one-half storage cells separated by oppositely facing one-half storage cells of substantially identical shape and cross-section. Each abutting pair of face-to-face shells forms a composite unit and defines a vertical row of spaced apart horizontal storage cells. Each adjacent abutting composite unit defines a vertical row of similar horizontal storage cells in staggered relation to the first row. The composite units substantially fill the space within the open frame and are supported by the frame top and base. Although the storage cells are preferably of hexagonal cross-section they may alternatively be of square cross section arrayed either horizontally or diagonally.

15 Claims, 3 Drawing Sheets

MODULAR STORAGE SYSTEM FOR CYLINDRICAL OBJECTS

BACKGROUND OF THE INVENTION

1. Field of the Invention

This invention is directed to a system for the storage of cylindrical objects such as rolled carpet, rolled maps and posters, rolled engineer's and architect's drawings, wallpaper rolls, wine bottles, and the like. Most specifically, the invention is directed to a modular honeycomb-like system for the storage of rolled, laundered carpet runners or mats of the type used in many public buildings, especially in wet weather, which are laid on the floor immediately inside of entrances to absorb most of the water and pick up most of the dirt carried in from the outside. These carpet runners quickly become soiled and are then laundered and rolled for use when next needed, using rolling machines such as those of my prior U.S. Pat. Nos. 4,573,644 and 4,973,010. The rolled runners or mats are then stored utilizing the system of the present invention, and may be transported for distribution as needed.

2. The Prior Art

Honeycomb structures are found in nature, primarily in bee hives, wasp and hornet nests, and the like. In the patent art, storage cells of hexagonal cross-section are shown in FIGS. 10 and 11 of Loftis U.S. Pat. No. 5,384,813. The wine rack of Jacobs U.S. Pat. No. 4,422,555 has generally hexagonal cross-section cells but the top and bottom surfaces are curved to match the contour of a wine bottle.

Wieland U.S. Pat. 2,664,307 is specific to storage of rugs or carpets. Duff U.S. Pat. No. 5,738,227 is specific to storage of floor covering. In one adaptation shown in FIG. 4, the rack of Aspen U.S. Pat. No. 4,223,792 may be used for storage of rolled material, such as carpeting.

Levine U.S. Pat. No. 4,660,727 disclosures a modular wine rack comprised of a plurality of horizontal undulating unitary "frames" held together by spring clips.

SUMMARY OF THE INVENTION

Broadly stated, the modular storage system for cylindrical objects according to the present invention comprises an open frame in the form of a right parallelepiped comprised of a horizontal rectangular base having spaced apart parallel front and rear beams connected at their ends by parallel spaced apart side beams, a horizontal rectangular top having spaced apart parallel front and rear beams connected at their ends by parallel spaced apart side beams, and vertical standards connecting the corners of the base and top. Within this frame there are disposed a plurality of pairs of left and right face-to-face vertically extending abutting mirror image shaped shells. Each mirror image shell is formed to define a plurality of alternating inwardly facing one-half storage cells separated by oppositely facing one-half storage cells of substantially identical shape and cross-section. Each abutting pair of face-to-face shells forms a composite unit and defines a vertical row of spaced apart horizontal storage cells. Each adjacent abutting composite unit defines a vertical row of similar horizontal storage cells in staggered relation to the first row. The composite units substantially fill the space within the open frame and are supported by the frame top and base. Although the storage cells are preferably of hexagonal cross-section they may alternatively be of square cross section arrayed either horizontally or diagonally.

BRIEF DESCRIPTION OF THE DRAWINGS

The invention is illustrated by the accompanying drawings in which the same numerals identify corresponding parts and in which.

DETAILED DESCRIPTION OF THE PREFERRED EMBODIMENT

Figure 1:
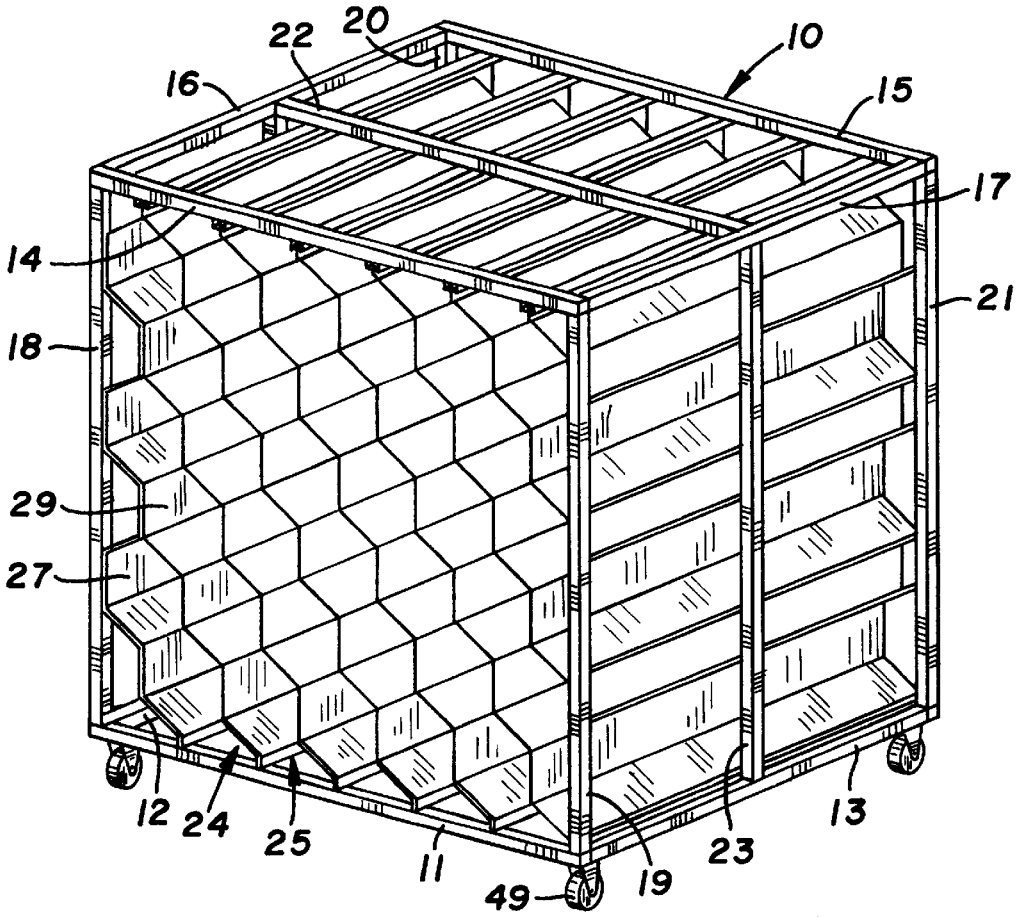
FIG. 1 is an isometric view of a preferred form of storage system for cylindrical objects according to the present invention, fitted with casters for easy transport.
Figure 2:
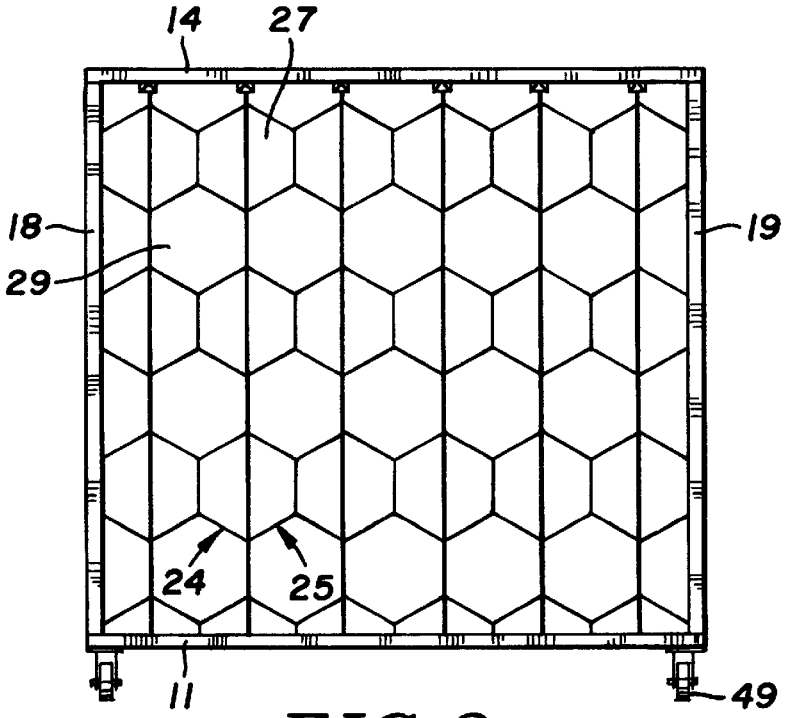
FIG. 2 is a front vertical elevation of the storage system of FIG. 1.

Referring now to the drawings there is shown a modular storage system for cylindrical objects according to the present invention indicated generally at 10 and comprising an open frame in the form of a right parallelepiped of dimensions commenserate with the particular cylindrical objects to be stored. The frame comprises a horizontal rectangular base having a front beam 11 and a corresponding parallel spaced apart rear beam (not visible) connected at their ends by left and right side beams 12 and 13, respectively. A corresponding horizontal rectangular frame top includes front and rear horizontal beams 14 and 15, respectively, joined at their ends by left and right side beams 16 and 17, respectively. Vertical front standards 18 and 19 and rear standards 20 and 21 connect the frame base and top at their corners. Horizontal bracing 22 and vertical bracing 23 maybe added as needed or desired. The frame is preferably formed from tubular steel members welded or otherwise rigidly secured together for a system for storing relatively heavy rolled up carpet runners or mats. Other materials may be used where different cylindrical objects are to be stored, as appropriate.

Figure 3:
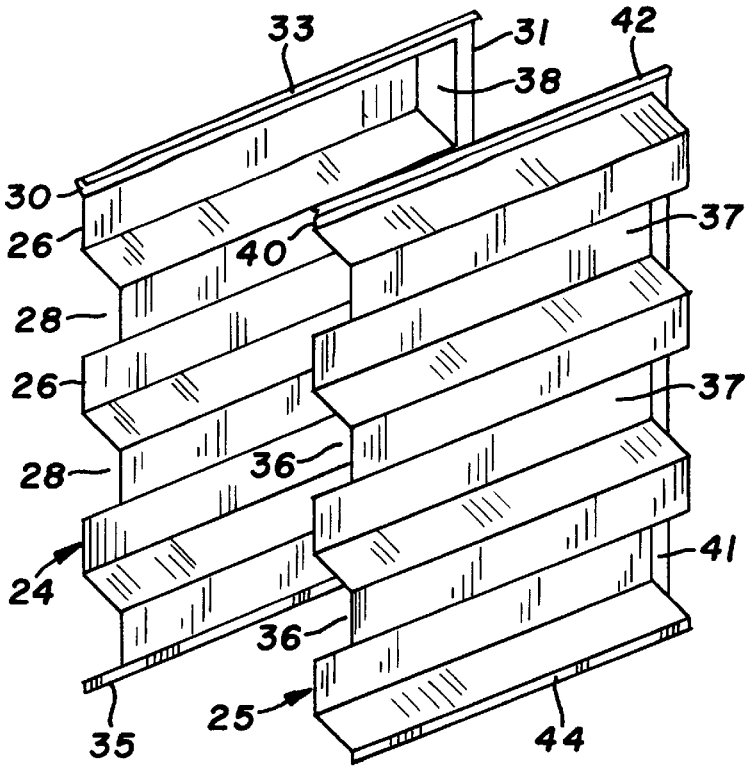
FIG. 3 is an exploded isometric view of the face-to-face mirror-image shells defining the storage cells of the system.

The space within the open frame is filled with a honeycomb-like system of horizontal storage cells extending from the front to the rear of the frame. As best seen in FIG. 3, the storage cells are defined by a series of pairs of abutting vertically extending left and right shells 24 and 25, respectively. Shells 24 and 25 are mirror images of one another disposed in abutting face-to-face relation. Shell 24 is formed or shaped to define a plurality of inwardly facing parallel horizontal cavities or cells 26 which form half of a storage cell 27 in the assembled system. The inwardly facing half-cell cells 26 are spaced apart by outwardly facing half cells 28 of the same size and cross section as cells 26. In the assembled system cells 28 define one half of a series of storage cells 29 in staggered relation with respect to cells 27. Shell 24 is provided with a top horizontal flange 30, and a rear vertical flange 31, both lying in a common plane. An outwardly extending lip or bead 33 is formed along the top edge of top flange 30. For added strength cells 26 are provided with integral rear walls 34. The bottommost end of shell 24 defines a partial cell 34 and includes a vertical flange 35.

Shell 25 is similar to shell 24 except that it is a mirror image. It is formed or shaped to define a plurality of inwardly facing half cells 36 which, in conjunction with half cells 26, define storage cells 27. Inwardly facing half cells 36 are spaced apart by outwardly facing half cells 37 of identical cross section. When one composite unit composed of shells 24 and 25 is assembled in abutment with another composite pair of shells, cell 37 of shell 25 defines storage cell 29 in conjunction with half cell 28 of shell 24. No adhesives or other fastening means are required to hold the abutting shells together nor to hold abutting composite pair units together. Shell 25 is provided with a horizontal top flange 40 and rear vertical flange 41, both lying in a common plane and engageable in abutment with flanges 30 and 31, respectively, of shell 24. Half cells 36 are provided with integral rear walls 39. The top edge of flange 40 is formed to provide an outwardly projecting lip or bead 42. The bottommost end of shell 25 defines a partial cell 43 and includes downwardly extending flange 44.

Shells 24 and 25 are desirably molded using high impact polystyrene or equivalent synthetic resinous plastic material. Alternatively, the shells may be formed from sheet metal.

A plurality of hangers or tracks 45 are provided, welded or otherwise rigidly secured to the bottom surfaces of frame top beams 14, 15 and 22. Each hanger or track 45 is in the form of a box beam having a central longitudinal slot in its bottommost wall. The combination of flanges 30 and 40 and lips or beads 33 and 42 forms a generally T-shaped structure which fits into the hanger. To assemble the system each pair of shells 24 and 25 is placed in face-to-face abutment and flanges 30 and 40 are fit into the slot of the box beam with lips or beads 33 and 42 within the hanger bracket to suspend and support the composite unit. One hanger is provided for each pair of shells and they are spaced apart so that the outside wall of half-cell 36 in shell 25 of one composite pair abuts the outside wall of half-cell 26 of shell 24 of the next adjacent composite pair, resulting in the formation of storage cells 29 between the composite pairs.

The frame is of a size to permit the assembly of the desired number of composite mirror image pairs of shells 24 and 25 with a slide fit. To prevent accidental partial displacement of the composite pairs of shells from the hanger bracket 45, they are preferably secured to the frame, as by riveting to the rear of the frame top.

Figure 4:
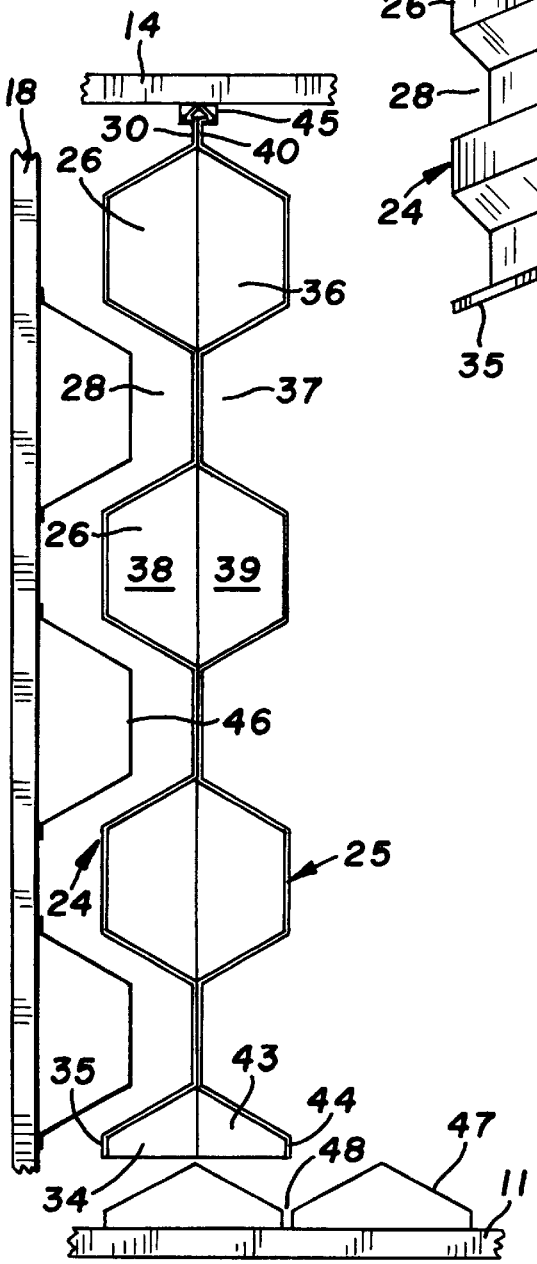
FIG. 4 is a fragmentary exploded elevation on an enlarged scale showing details of construction of the system.

As best seen in FIG. 4, to prevent lateral displacement or bulging of the shells under weight of the objects being stored, horizontally extending lateral supports 46 of configuration conforming to outwardly facing cells 28 and 37 are provided. Supports 46 are desirably formed from sheet metal and are secured by welding or other fastening means to the inside edges of standards 18 and 20 and 19 and 21 forming the sides of frame 10. The supports may be formed, for example, from 18 gauge, sheet metal. The outside surfaces of the inwardly facing cells are supported by bearing against the standards forming the sides of the frame. Bottom supports 47 corresponding in cross-section to the partial cell 34, 43 at the bottom of each composite pair of shells are supported by the frame base. Bottom supports 47 are spaced apart to provide channels 48 into which abutting flanges 35 and 44 of adjacent composite pairs of shells are received.

For some purposes, the storage system is preferably made mobile by the provision of casters 49, as when the stored objects are laundered rolled carpet mats for distribution to locations where needed. Alternatively, the system may be transported by a fork lift truck or the like.

Figure 5:
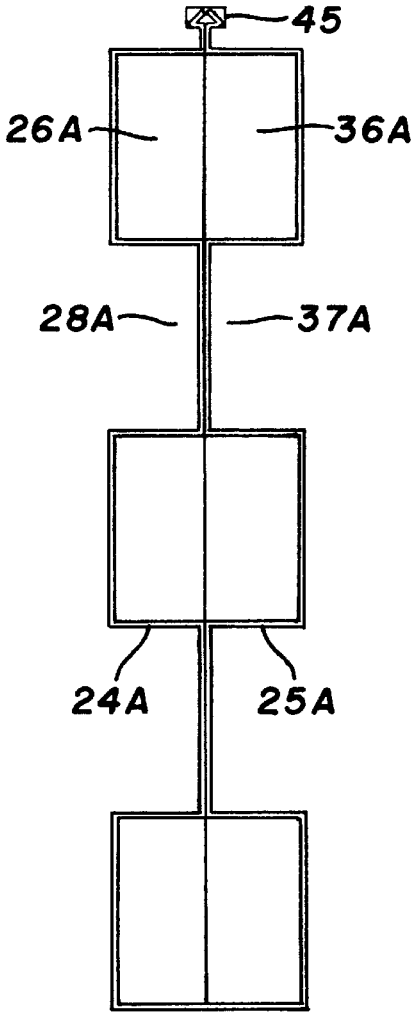
FIGS. 5 and 6 are schematic elevations of mirror image shells defining storage cells of alternative cross sections.
Figure 6:
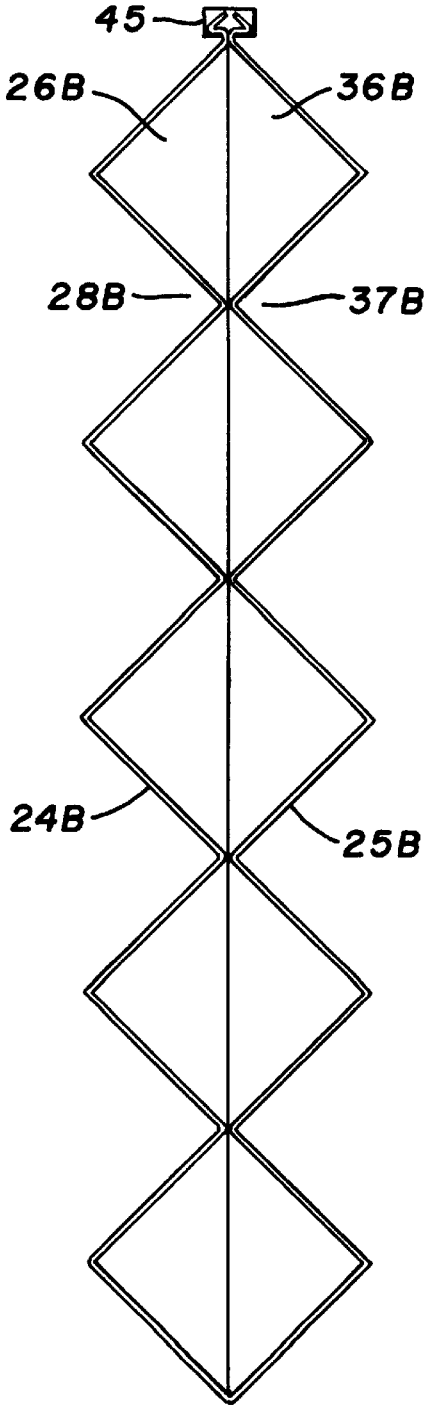

Although the invention as illustrated in FIGS. 1 through 4 is in its preferred form in which the storage cells are of hexagonal cross section, other cross-sectional shapes may be used as well. For example, in FIG. 5 an alternative form of mirror image shells 24A and 25A is shown. Shells 24A and 25A, when in abutment, provide square storage cells in a traditional grid pattern. Similarly, in FIG. 6 there is shown another alternative form of mirror image shells 24B and 25B which, when in abutment, provide square storage cells in a staggered diamond pattern.

It is apparent that many modifications and variations of this invention as hereinbefore set forth may be made without departing from the spirit and scope thereof. The specific embodiments described are given by way of example only and the invention is limited only by the terms of the appended claims.

The embodiments of the invention in which an exclusive property or privilege is claimed are defined as follows:

1. A modular storage system for cylindrical objects comprising:

A) an open frame in the form of a right parallelepiped comprised of:

1. a horizontal rectangular base having spaced apart parallel front and rear beams connected at their ends by parallel spaced apart side beams,
2. a horizontal rectangular top having spaced apart parallel front and rear beams connected at their ends by parallel spaced apart side beams, and
3. vertical standards connecting the corners of said base and said top, said vertical standards having inside edges, B) a plurality of pairs of left and right face-to-face vertically extending abutting mirror image shaped shells within the frame, each formed to define a plurality of alternating inwardly facing horizontally extending one-half storage cells separated by oppositely outwardly facing one-half storage cells of substantially identical size and cross-section, whereby each abutting pair of face-to-face shells forms a composite unit and defines a vertical row of horizontal storage cells and each adjacent abutting composite unit defines a vertical row of similar horizontal storage cells in staggered relation to said first row, C) a plurality of parallel spaced apart horizontal supports, equal in number to said composite shell units, secured to the frame top for engagement with the top ends of each pair of shells, and D) horizontally extending lateral supports secured to the inside edges of said vertical standards of said frame, said lateral supports corresponding in cross-section to the outwardly facing one-half storage cells.

2. A modular storage system according to claim 1 wherein each of said shells is provided with a vertically projecting horizontal top flange and a horizontally projecting rear vertical flange, said flanges lying in a common plane and abuttable in face-to-face relation.

3. A modular storage system according to claim 2 wherein:

A) said horizontal supports for engagement with the top ends of said shells comprises a box beam having a central longitudinal slot in its bottommost wall, B) a lip extends outwardly from the top edge of the top flange of each of said shells, C) said flanges in abutting relation extend through said slot and said lips engage the inside of the box beam.

4. A modular storage system according to claim 1 wherein: a plurality of parallel spaced apart horizontal supports are secured to the frame base for engagement with the bottom ends of each pair of shells.

5. A modular storage system according to claim 4 wherein: the bottommost ends of said composite pairs of shells are formed to define partial half cells and said horizontal supports correspond in cross section to said partial half cells.

6. A modular storage system according to claim 1 wherein: said shells are formed by molding from a synthetic resinous plastic material.

7. A modular storage system according to claim 6 wherein: said plastic material is high impact polystyrene.

8. A modular storage system according to claim 1 wherein: an integral rear wall is formed in each of the inwardly facing one-half storage cell of each of said shells.

9. A modular storage system according to claim 1 wherein: each of the one-half storage cell formed in each of said shells is of semi-hexagonal cross-section.

10. A modular storage system for cylindrical objects comprising:

A) an open frame in the form of a right parallelepiped comprised of:

1. a horizontal rectangular base having spaced apart parallel front and rear beams connected at their ends by parallel spaced apart side beams,
2. a horizontal rectangular top having spaced apart parallel front and rear beams connected at their ends by parallel spaced apart side beams, and
3. vertical standards connecting the comers of said base and said top, said vertical standards having inside edges, B) a plurality of pairs of left and right face-to-face vertically extending abutting mirror image shaped shells within the frame, each shell formed to define a plurality of alternating inwardly facing horizontally extending one-half semi-hexagonal storage cells separated by oppositely outwardly facing one-half semi-hexagonal storage cells of substantially identical size and cross-section, whereby each abutting pair of face-to-face shells forms a composite unit and defines a vertical row of horizontal hexagonal storage cells and each adjacent composite unit defines a vertical row of similar horizontal storage cells in staggered relation to said first row, C) a vertically projecting horizontal top flange at the top of each shell and a horizontal projecting vertical flange along the rear edge of each shell, said flanges lying in a common plane and abuttable in face-to-face relation, D) a plurality of parallel spaced apart horizontal supports, equal in number to said composite shell units, secured to the frame top for engagement with the top ends of each pair of shells, each of said supports comprising a box beam having a central longitudinal slot in its bottommost wall, E) a lip extending outwardly from the top edge of the top flange of each of said shells, said flanges in abutting relation extending through said slot and said lips engaging the inside of the box beam, and F) horizontally extending lateral supports secured to the inside edges of said vertical standards of said frame, said lateral supports corresponding in cross-section to the outwardly facing one-half cells.

11. A modular storage system according to claim 10 wherein a plurality of parallel spaced apart horizontal supports are secured to the frame base for engagement with the bottom ends of each pair of shells.

12. A modular storage system according to claim 11 wherein the bottommost ends of said composite pairs of shells are formed to define a partial half cell and said horizontal supports correspond in cross section to said partial half cell.

13. A modular storage system according to claim 10 wherein: said shells are formed by molding from a synthetic resinous plastic material.

14. A modular storage system according to claim 13 wherein: said plastic material is high impact polystyrene.

15. A modular storage system according to claim 10 wherein: an integral rear wall is formed in each of the inwardly facing one-half storage cell of each of said shells.

* * * * *